US010659905B1

(12) United States Patent
Tu et al.

(10) Patent No.: US 10,659,905 B1
(45) Date of Patent: May 19, 2020

(54) METHOD, SYSTEM, AND PROCESSING DEVICE FOR CORRECTING ENERGY DISTRIBUTIONS OF AUDIO SIGNAL

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/508,317

(22) Filed: Jul. 11, 2019

(30) Foreign Application Priority Data

Feb. 1, 2019 (TW) ..... 108104026 A

(51) Int. Cl.

| | |
|---|---|
| ***H04S 7/00*** | (2006.01) |
| ***H04R 5/02*** | (2006.01) |
| ***H04S 3/00*** | (2006.01) |
| ***H04R 5/04*** | (2006.01) |

(52) U.S. Cl.
CPC ..... *H04S 7/303* (2013.01); *H04R 5/02* (2013.01); *H04R 5/04* (2013.01); *H04S 3/008* (2013.01); *H04S 2400/01* (2013.01); *H04S 2400/13* (2013.01)

(58) Field of Classification Search
CPC ..... H04S 2420/01; H04S 7/304; H04S 7/303; H04S 2400/11; H04S 2400/13; H04S 2400/01; H04S 3/008; H04S 3/00; H04S 5/00; H04S 5/02; H04S 7/308; G06T 19/006; H04R 5/033; H04R 5/02; H04R 5/04; G10L 19/008
USPC ..... 381/1, 5, 10, 17, 18, 74, 98, 107, 306, 381/307, 310
See application file for complete search history.

(56) References Cited

U.S. PATENT DOCUMENTS

2011/0137662 A1* 6/2011 McGrath ..... G10L 19/008 704/500

FOREIGN PATENT DOCUMENTS

CN 102124516 7/2011

* cited by examiner

*Primary Examiner* — Norman Yu
(74) *Attorney, Agent, or Firm* — JCIPRNET

(57) ABSTRACT

A method and a system for correcting energy distributions of audio signal are proposed. The method is applicable to a head-mounted device having a motion sensor, a left speaker, and a right speaker and includes the following steps. A rotation angle of the head-mounted device is detected by the motion sensor. Dual-channel audio signals corresponding to the left and right speakers are obtained. The dual-channel audio signals are converted to multi-channel audio signals with the number of channels greater than or equal to 5. Four acoustic source positions of the left and right speakers are defined to convert the multi-channel audio signals to four-channel audio signals of the left and right speakers. Energy distributions of the four-channel audio signals of the left and right speakers are corrected according to the rotation angle and the four acoustic source positions to respectively generate a left output signal and a right output signal.

19 Claims, 5 Drawing Sheets

200

220

METHOD, SYSTEM, AND PROCESSING DEVICE FOR CORRECTING ENERGY DISTRIBUTIONS OF AUDIO SIGNAL

CROSS-REFERENCE TO RELATED APPLICATION

This application claims the priority benefit of Taiwan application serial no. 108104026, filed on Feb. 1, 2019. The entirety of the above-mentioned patent application is hereby incorporated by reference herein and made a part of this specification.

TECHNICAL FIELD

The disclosure relates to a technique for correcting energy distributions of audio signal.

BACKGROUND

Virtual reality creates an illusion of reality with realistic audio, video, and other sensations that replicate real environments or imaginary settings. A virtual reality environment offers a user immersion, navigation, and manipulation that simulate his physical presence in the real world or imaginary world. However, when a screen image of a VR head-mounted device available on the market rotates along with the user's movement, an audio signal of an earphone often fails to change synchronously, and this results in a mismatch between energy distributions of the audio signal and the user's head movement.

SUMMARY

The disclosure provides a method, a system, and a processing device for correcting energy distributions of audio signal, which allows a proper match between energy distributions of an audio signal and the user's head movement.

In an embodiment of the disclosure, the method is applicable to a head-mounted device having a motion sensor, a left speaker and a right speaker, and includes the following steps. A rotation angle of the head-mounted device is detected by the motion sensor. Dual-channel audio signals corresponding to the left speaker and the right speaker are obtained. The dual-channel audio signals are converted to multi-channel audio signals. The number of channels of the multi-channel audio signal is greater than or equal to 5. Four acoustic source positions of the left and right speakers are defined to convert the multi-channel audio signals to four-channel audio signals of the left speaker and four-channel audio signals of the right speaker. Energy distributions of the four-channel audio signals of the left speaker and the right speaker are corrected according to the rotation angle and the four acoustic source positions to respectively generate a left output signal corresponding to the left speaker and a right output signal corresponding to the right speaker.

In an embodiment of the disclosure, the system includes a head-mounted device and a processing device. The head-mounted device includes a motion sensor, a left speaker and a right speaker. The processing device is configured to detect a rotation angle of the head-mounted device by the motion sensor, obtain dual-channel audio signals corresponding to the left speaker and the right speaker, convert the dual-channel audio signals to multi-channel audio signals having the number of channels greater than or equal to 5, define four acoustic source positions of the left speaker and the right speaker to convert the multi-channel audio signals to four-channel audio signals of the left speaker and four-channel audio signals of the right speaker, and correct energy distributions of the four-channel audio signals of the left speaker and the right speaker according to the rotation angle and the four acoustic source positions to respectively generate a left output signal corresponding to the left speaker and a right output signal corresponding to the right speaker.

In an embodiment of the disclosure, the processing device is connected to or coupled to a head-mounted device having a motion sensor, a left speaker, and a right speaker and includes a memory and a processor. The processor is configured to obtain a rotation angle of the head-mounted device detected by the motion sensor from the head-mounted device, obtain dual-channel audio signals corresponding to the left speaker and the right speaker from the head-mounted device, convert the dual-channel audio signals to multi-channel audio signals having the number of channels greater than or equal to 5, define four acoustic source positions of the left speaker and the right speaker to convert the multi-channel audio signals to four-channel audio signals of the left speaker and four-channel audio signals of the right speaker, define four acoustic source positions of the left speaker and the right speaker to convert the multi-channel audio signals to four-channel audio signals of the left speaker and four-channel audio signals of the right speaker, and correct energy distributions of the four-channel audio signals of the left speaker and the right speaker according to the rotation angle and the four acoustic source positions to respectively generate a left output signal corresponding to the left speaker and a right output signal corresponding to the right speaker.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION

Figure 1:
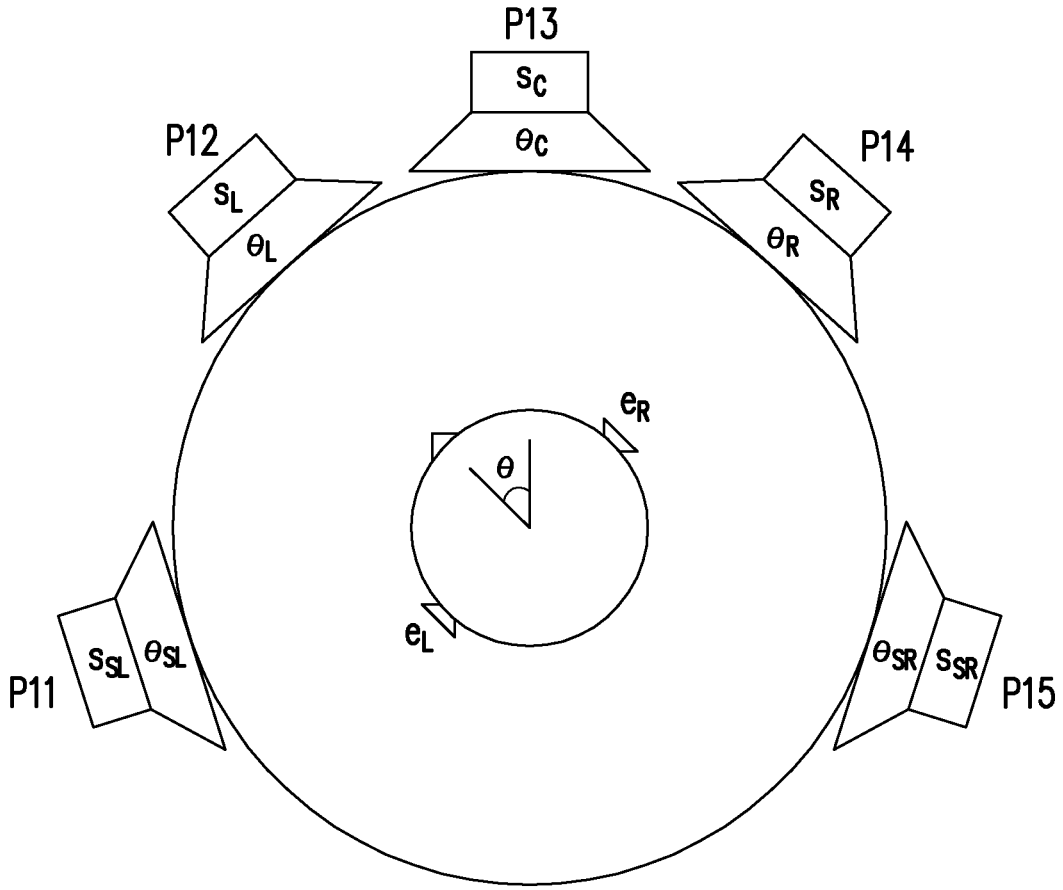
FIG. 1 is a schematic diagram of five-channel audio signals in a general stereo field.

Reference will now be made in detail to the present preferred embodiments of the disclosure, examples of which are illustrated in the accompanying drawings. Wherever possible, the same reference numbers are used in the drawings and the description to refer to the same or like parts.

In a general stereo field, five-channel audio signals with new positions are first generated based on dual-channel audio signals. Then, an interaural intensity difference (IID) technology is used to synthesize new five-channel audio signals based on a relative positional relationship between each new channel and the old channel. Finally, the five-channel audio signals are converted to dual-channel audio signals for output. With a schematic diagram of the five-channel audio signals of a stereo field illustrated in FIG. 1 as an example, five-channel audio signals $s_L$, $s_C$, $s_R$, $s_S^L$ and $s_S^R$ corresponding to acoustic source positions P11, P12, P13, P14 and P15 (or corresponding to angles $\theta_{SL}$, $\theta_L$, $\theta_C$, $\theta_R$ and $\theta_{SR}$) may be synthesized from dual-channel audio signals $e_L$ and $e_R$. However, since this is an optimal setting for the user facing forward (i.e., $\theta=0$), when $\theta=0$, energy distributions of the left and right channel signals would be consistent with original signals. When the user turns backward (i.e., $\theta=180°$), the energy distributions of the left and right channel signals would not only be left/right opposite to the original signals but would also have significant differences in magnitudes. Accordingly, the disclosure would be able to dynamically correct the energy distributions of the audio signal according to the user's rotation angle so as to allow a proper match between energy distributions of an audio signal and the user's head movement.

Some embodiments of the disclosure will now be described more fully hereinafter with reference to the accompanying drawings, in which some, but not all embodiments of the application are shown. Indeed, various embodiments of the disclosure may be embodied in many different forms and should not be construed as limited to the embodiments set forth herein; rather, these embodiments are provided so that this disclosure will satisfy applicable legal requirements. Like reference numerals refer to like elements throughout.

Figure 2A:
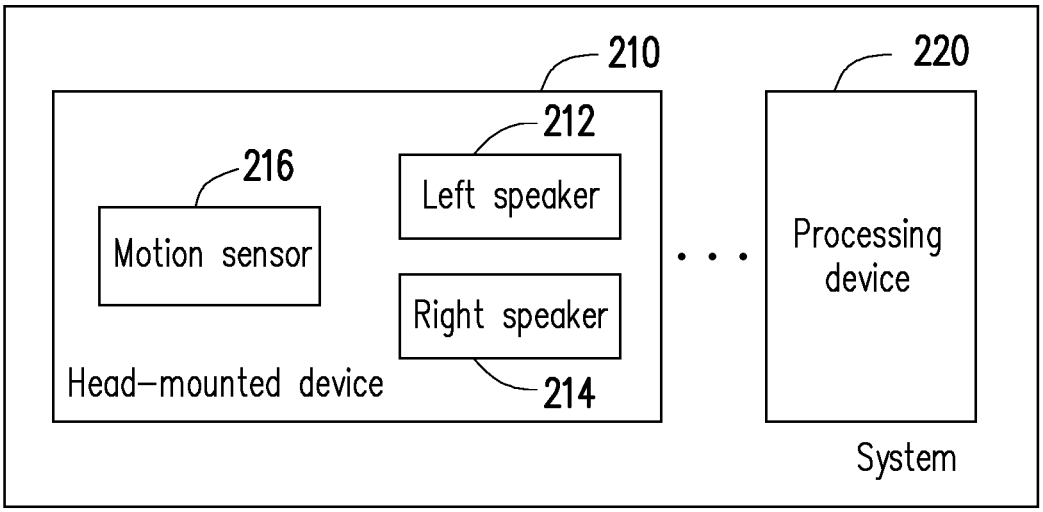
FIG. 2A is a block diagram illustrating a system for correcting energy distributions of an audio signal according to an embodiment of the disclosure.

FIG. 2A is a block diagram illustrating a system for correcting energy distributions of an audio signal according to an embodiment of the disclosure. All components of the system and their configurations are first introduced in FIG. 2A. The functionalities of the components are disclosed in more detail in conjunction with FIG. 3.

With reference to FIG. 2A, a system 200 would at least include a head-mounted device 210 and a processing device 220. Herein, the processing device 220 may be built-in into the head-mounted device 210, or wirelessly, wiredly, or electrically connected to the head-mounted device 210.

Specifically, the head-mounted device 210 may be a head-mounted display or goggles having a left speaker 212, a right speaker 214 and a motion sensor 216, and may be implemented as a virtual reality head-mounted device, an augmented reality head-mounted device or a mixed reality head-mounted device. The left speaker 212 and the right speaker 214 would be configured to play audio signals. The motion sensor 216 may be an accelerometer (e.g., a gravity sensor), a gyroscope (e.g., a gyroscope sensor), or any sensors capable of detecting a linear movement, a linear movement direction and a rotation movement (e.g., a rotational angular velocity or a rotation angle) of the head-mounted device 210.

Figure 2B:
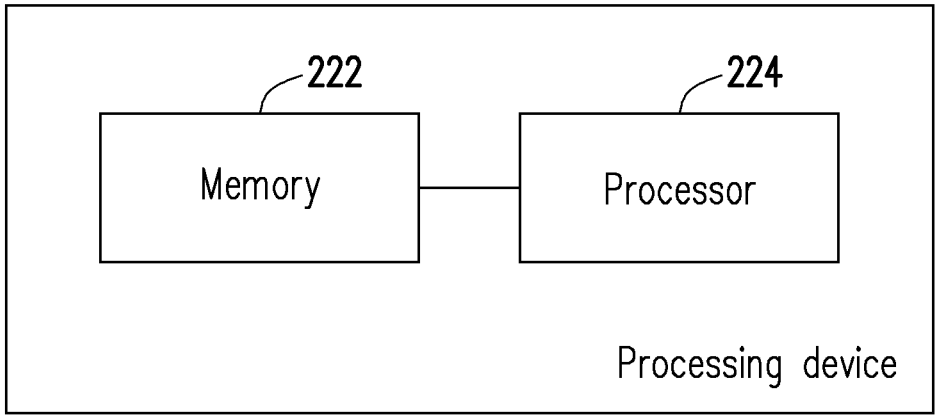
FIG. 2B is a block diagram illustrating a processing device for correcting energy distributions of an audio signal according to an embodiment of the disclosure.

The processing device 220 would be configured to control operations of the system 200. The processing device 220 may include a memory 222 and a processor 224 as illustrated in FIG. 2B according to an embodiment of the disclosure. The memory 222 may be, for example, a fixed or movable device in any possible forms, including a random access memory (RAM), a read-only memory (ROM), a flash memory, a hard drive or other similar devices, integrated circuits or a combination of the above-mentioned devices. The processor 224 may be, for example, a central processing unit (CPU), an application processor (AP) or other programmable microprocessors for general purpose or special purpose, a digital signal processor (DSP), an audio processor, or other similar devices, integrated circuits or a combination of the above. For instance, the processor 224 may include a central processing unit and an audio processor. Here, the audio processor may further include a digital signal processor and a sound codec.

In this embodiment, the processing device 220 may be a computer device having computing capability and the processor, such as a file server, a database server, an application server, a work station, a personal computer, and so forth. Further, the head-mounted device 210 and the processing device 220 may transmit information in any conventional wired or wireless standard through their respective communication interfaces. In another embodiment, the processing device 220 may be built-in into the head-mounted device 210 as an all-in-one system.

Figure 3:
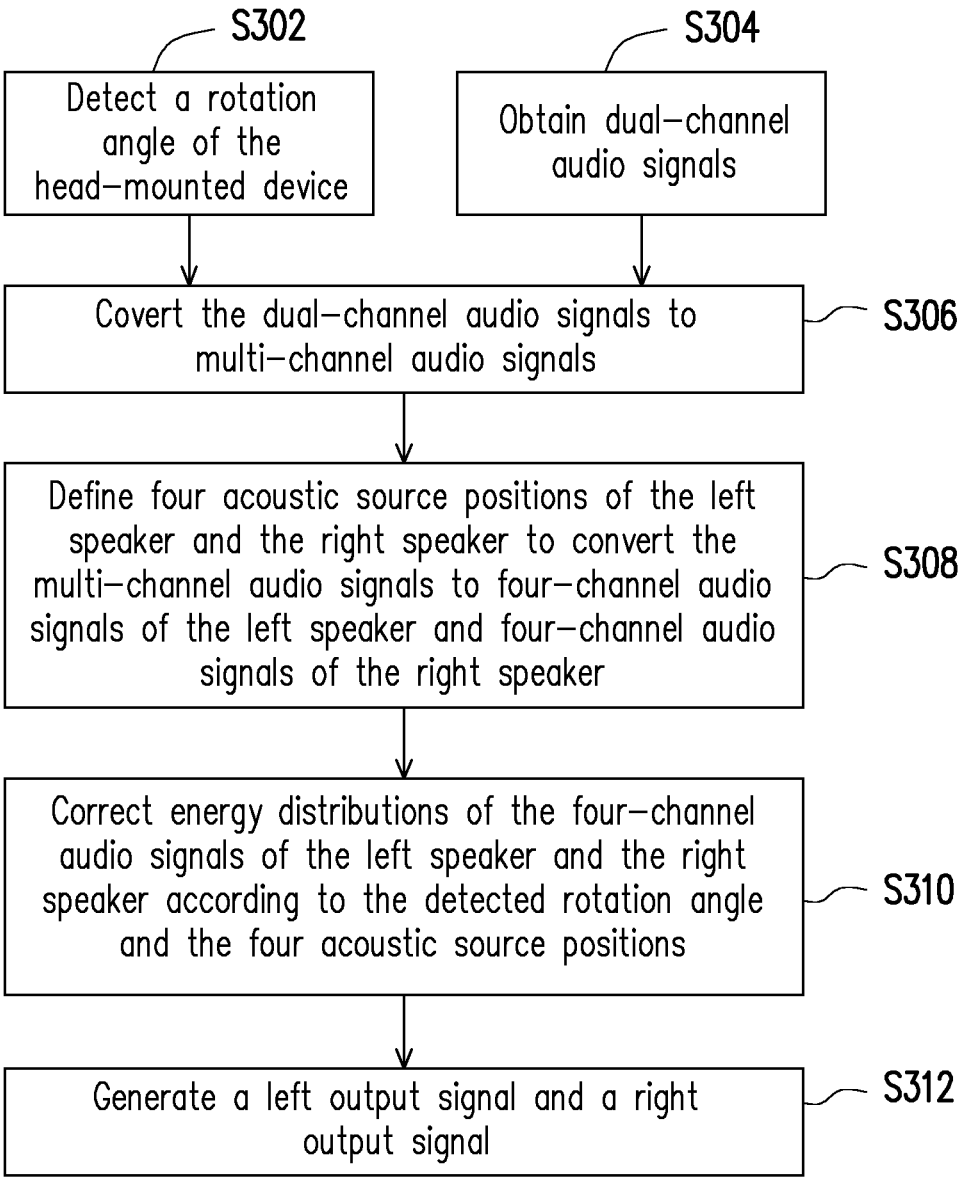
FIG. 3 is a flowchart illustrating a method for correcting energy distributions of an audio signal according to an embodiment of the disclosure.

FIG. 3 is a flowchart illustrating a method for correcting energy distributions of an audio signal according to an embodiment of the disclosure, and the process in the method of FIG. 3 may be implemented by the system 200 of FIG. 2.

Referring to FIG. 3 along with FIG. 2A, the processing device 220 would detect a rotation angle of the head-mounted device 210 by using the motion sensor 216 of the head-mounted device 210 (step S302) and obtain dual-channel audio signals corresponding to the left speaker 212 and the right speaker 214 (step S304). In terms of a fixed acoustic source, while the user is wearing the head-mounted device 210, user perceptions in audio are identical for head-up and head-down movements and are only affected by left-and-right rotations. Therefore, the rotation angle herein would refer to a rotation of the head-mounted device 210 with respect to a horizontal axis, and the dual-channel audio signals would refer to dual-channel stereo signals having a left audio signal and a right audio signal used in general games, audios and videos.

Next, the processing device 220 would convert the dual-channel audio signals to multi-channel audio signals (step S306). In this embodiment, the processing device 220 may convert the dual-channel audio signals to original multi-channel audio signals by leveraging the Dolby digital algorithm as known per se, and then perform dynamic gain adjustment on each of the original multi-channel audio signals according to characteristics of the dual-channel audio signals to generate the multi-channel audio signals. The number of the multi-channel audio signals herein may be greater than or equal to 5 (five-channel audio signals, seven-channel audio signals, etc.). Five-channel audio signals would be used as an example for illustration.

The processing device 220 would define four acoustic source positions of the left speaker 212 and the right speaker 214 to convert the multi-channel audio signals to four-channel audio signals of the left speaker 212 and four-channel audio signals of the right speaker 214 (step S308), so as to convert the multi-channel audio signals to symmetrical four acoustic sources. Herein, the four acoustic sources of the left speaker 212 would be different from the four acoustic sources of the right speaker 214. In other words, the processing device 220 may assign four of channel audio signals of the multi-channel audio signals to the four acoustic source positions of the left speaker 212 and the right speaker 214, and the four channel audio signals assigned to the two speakers may not be exactly identical. In the example of the five-channel audio signals, the left speaker 212 and the right speaker 214 may each cancel one surround acoustic source.

Figure 4A:
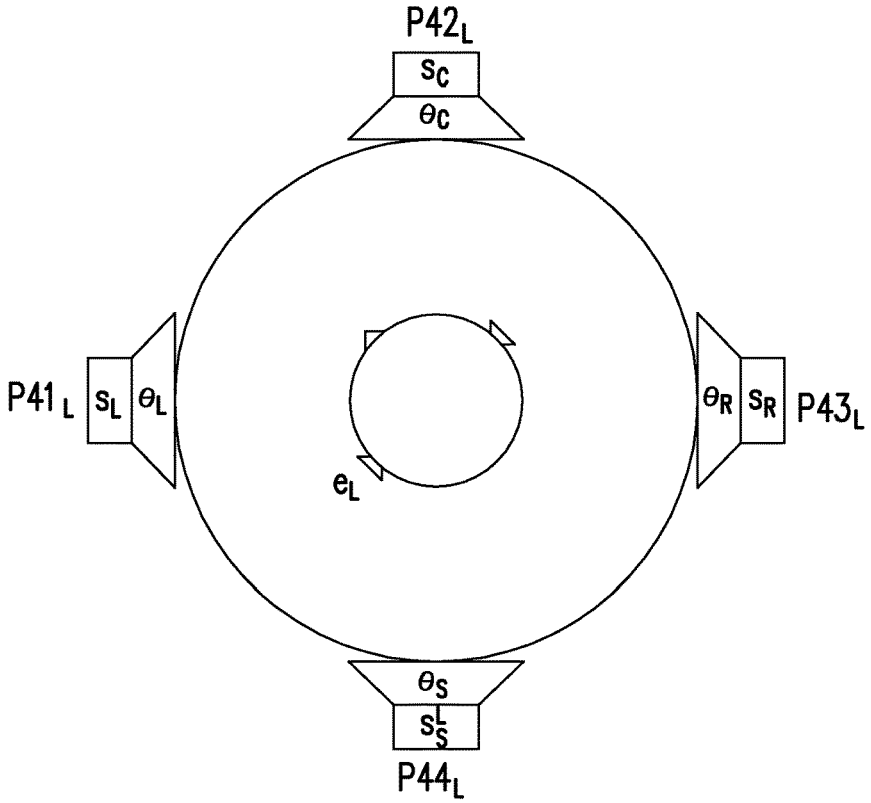
FIG. 4A and FIG. 4B are schematic diagrams respectively illustrating four acoustic source positions and signals of a left speaker and a right speaker according to an embodiment of the disclosure.
Figure 4B:
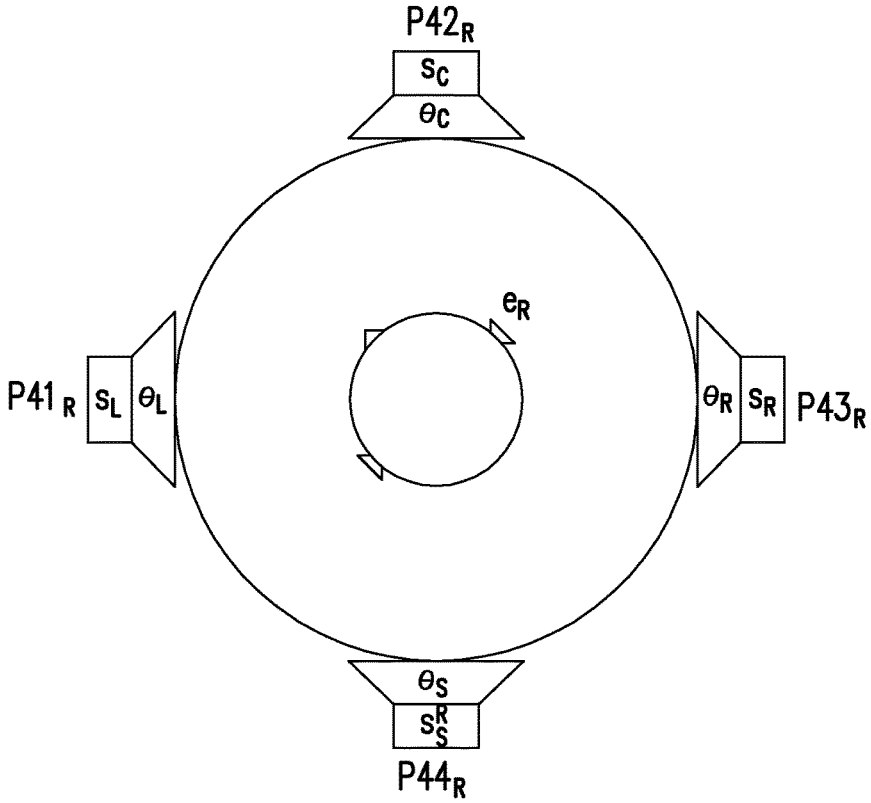

Specifically, FIG. 4A and FIG. 4B are schematic diagrams respectively illustrating four acoustic source positions and signals of the left speaker 212 and the right speaker 214 according to an embodiment of the disclosure. First of all, it is assumed that the dual-channel audio signals may be split into a right-channel audio signal $e_L$ and a left-channel audio signal $e_R$ and the dual-channel audio signals may be converted to original five-channel audio signals. Then, dynamic gain adjustment would be performed on each axis according to related characteristics of the left-channel audio signal $e_L$ and the right-channel audio signal $e_R$ to generate a left-channel audio signal $s_L$, a center-channel audio signal $s_C$, a right-channel audio signal $s_R$, a left surround signal $s_S^L$ and a right surround signal $s_S^R$.

With reference to FIG. 4A, it is assumed that the dual-channel audio signals are split into the left-channel audio signal $e_L$ and the right-channel audio signal e R, the four acoustic source positions will be set to a first acoustic source position P41$_L$, a second acoustic source position P42$_L$, a third acoustic source position P43$_L$ and a fourth acoustic source position P44$_L$. Among them, a line connecting the first acoustic source position P41$_L$ and the third acoustic source position P43$_L$ and a line connecting the second acoustic source position P42$_L$ and the fourth acoustic source position P44$_L$ would be perpendicular to each other. From another perspective, for the left speaker 212 corresponding to the left-channel audio signal $e_L$ of the dual-channel audio signals, the first acoustic source position P41$_L$, the second acoustic source position P42$_L$, the third acoustic source position P43$_L$ and the fourth acoustic source position P44$_L$ may be positions respectively corresponding to 0-degree angle, 90-degree angle, 180-degree angle and 270-degree angle (which may be respectively represented by $\theta_L$=0°, $\theta_C$=90°, $\theta_R$=180°, $\theta_S$=270°), and the left-channel audio signal $s_L$, the center-channel audio signal $s_C$, the right-channel audio signal $s_R$ and the left surround signal $s_S$ would be respectively assigned to these four acoustic source positions. For the left speaker 212, the right surround signal would be cancelled.

With reference to FIG. 4B, similarly, the four acoustic source positions will be set to a first acoustic source position P41$_R$, second acoustic source position P42$_R$, a third acoustic source position P43$_R$ and a fourth acoustic source position P44$_R$. Among them, a line connecting the first acoustic source position P41$_R$ and the third acoustic source position P43$_R$ and a line connecting the second acoustic source position P42$_R$ and the fourth acoustic source position P44$_R$ would be perpendicular to each other. From another perspective, for the left speaker 214 corresponding to the left-channel audio signal $e_R$ of the dual-channel audio signals, the first acoustic source position P41$_R$, the second acoustic source position P42$_R$, the third acoustic source position P43$_R$ and the fourth acoustic source position P44$_R$ may be positions respectively corresponding to 0-degree angle, 90-degree angle, 180-degree angle and 270-degree angle (which may be respectively represented by $\theta_L$=0°, $\theta_C$=90°, $\theta_R$=180°, $\theta_S$=270°), and the left-channel audio signal $s_L$, the center-channel audio signal $s_C$, the right-channel audio signal $s_R$ and the right surround signal $s_S$ would be respectively assigned to these four acoustic source positions. For the right speaker 214, the left surround signal would be cancelled.

Referring back to FIG. 3, after converting the multi-channel audio signals to the four-channel audio signals, the processing device 220 would correct energy distributions of the four-channel audio signals of the left speaker 212 and the right speaker 214 according to the detected rotation angle of the head-mount device 110 and the four acoustic source positions (step S310), so as to generate a left output signal and a right output signal (step S312). Specifically, the processing device 220 may adaptively adjust the energy distributions of the left speaker 212 and the right speaker 214 according to the rotation angle of the head-mounted device 110 so as to allow a proper match between energy distributions of an audio signal and the user's head movement. For the left speaker 212, the processing device 220 may set a left gain curve of the four-channel audio signals of the left speaker 212 according to the rotation angle and the four acoustic source positions. For the right speaker, the processing device 220 may set a right gain curve of the four-channel audio signals of the right speaker according to the rotation angle and the four acoustic source positions. Herein, the left gain curve may be different from the right gain curve. In the example of converting the five-channel audio signals to the four-channel audio signals, a gain value corresponding to the left-channel audio signal and a gain value corresponding to the left surround signal in the left gain curve may be both greater than a gain value corresponding to the center-channel audio signal and a gain value corresponding to the right surround signal in the left gain curve, and a gain value corresponding to the left-channel audio signal and a gain value corresponding to the left surround signal in the right gain curve may be both less than a gain value corresponding to the left-channel audio signal and a gain value corresponding to the left surround signal in the right gain curve. Then, the processing device 220 may synthesize the four-channel audio signals of the left speaker 212 according to the left gain curve to generate the left output signal, and synthesize the four-channel audio signals of the right speaker 214 according to the right gain curve to generate the right output signal. The left output signal and the right output signal would be respectively outputted by the left speaker 212 and the right speaker 214.

In this embodiment, the left gain curve and the right gain curve can respectively follow a cardioid distribution and respectively face different directions. Specifically, FIG. 5A and FIG. 5B are schematic diagrams respectively illustrating the gain curves of the left speaker 212 and the right speaker 214 according to an embodiment of the disclosure.

Figure 5A:
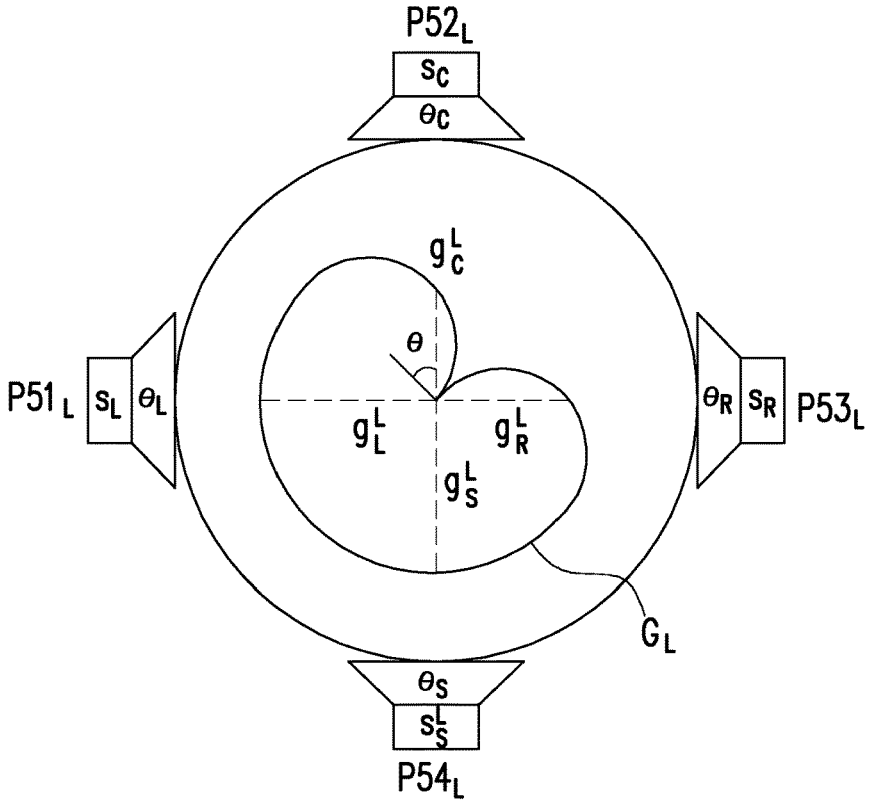
FIG. 5A and FIG. 5B are schematic diagrams respectively illustrating gain curves of a left speaker and a right speaker according to an embodiment of the disclosure.
Figure 5B:
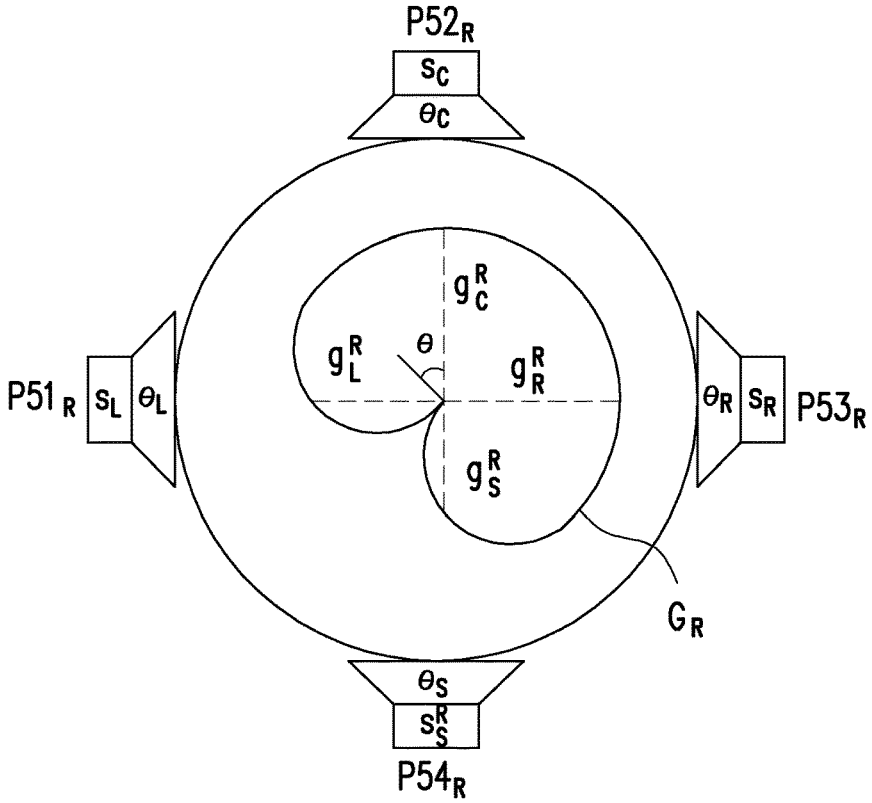

Referring to both FIG. 5A and FIG. 5B, it is assumed that the rotation angle of the head-mounted device 210 is θ, the four acoustic source positions of the left speaker 212 are set to P51$_L$, P52$_L$, P53$_L$ and P54$_L$, and the four acoustic source positions of the right speaker 212 are set to P51$_R$, P52$_R$, P53$_R$ and P54$_R$. Given that i=C, L, S, R, a left gain curve $g^L$ and a right gain curve $g^R$ would follow the cardioid distribution: when $0 \le \theta_i^D \le 180$, $$g_i^R = \left|\cos\left(\frac{\theta_i^D \cdot \pi}{180}\right)\right| \text{ and } g_i^L = 1; \text{ otherwise, } g_i^R = 1 \text{ and } g_i^L = \left|\cos\left(\frac{\theta_i^D \cdot \pi}{180}\right)\right|.$$

For FIG. 5A corresponding to the left speaker 212 (the left ear of the user), a gain value $g_L^L$ of the left-channel audio signal $s_L$ and a gain value $g_S^L$ of the left surround signal $s_S^L$ would be both greater than a gain value $g_C^L$ of the center-channel audio signal $s_C$ and a gain value $g_R^L$ of the right-channel audio signal $s_R$. For FIG. 5B corresponding to the right speaker 214 (the right ear of the user), a gain value $g_R^R$ of the right-channel audio signal $s_R$ and a gain value $g_S^R$ of the right surround signal $s_S^R$ would be both greater than a gain value $g_L^R$ of the left-channel audio signal $s_L$ and a gain value $g_C^R$ of the center-channel audio signal $s_C$. Then, the left-channel audio signal $s_L$, the center-channel audio signal $s_C$, the right-channel audio signal $s_R$, the left surround signal $s_S^L$ and the right surround signal $s_S^R$ would be adjusted by each of the gain values $g_i^L$ and $g_i^R$ to generate adjusted signals $x_i^L$ and $x_i^R$. Then, a left output signal $X_L$ and a right output signal $X_R$ would be generated by performing any synthesizing method on each of the channel audio signals.

In summary, according to the method, the system, and the processing device for correcting energy distributions of audio signal proposed in the disclosure, dual-channel audio signals would be first converted to multi-channel audio signals, then the multi-channel audio signals would be converted to the four-channel audio signals corresponding to the left speaker and the right speaker, and the energy distributions of the four-channel audio signals would be adaptively corrected according to a rotation angle of the head-mounted device. The disclosure can be practically applied to any general VR head-mounted device on the market. When a screen image rotates along with the user's movement, the energy distributions of an audio signal in the earphone would be changed synchronously so as to allow a proper match between image content of the screen image viewed by the user and audio heard by the user.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A method for correcting energy distributions of audio signal, applicable to a head-mounted device having a motion sensor, a left speaker, and a right speaker, wherein the method comprises:

detecting a rotation angle of the head-mounted device by using the motion sensor, and obtaining dual-channel audio signals corresponding to the left speaker and the right speaker;

converting the dual-channel audio signals to multi-channel audio signals, wherein the number of channels of the multi-channel audio signal is greater than or equal to 5;

defining four acoustic source positions of the left speaker and the right speaker to convert the multi-channel audio signals to four-channel audio signals of the left speaker and four-channel audio signals of the right speaker; and correcting energy distributions of the four-channel audio signals of the left speaker and the right speaker according to the rotation angle and the four acoustic source positions to respectively generate a left output signal corresponding to the left speaker and a right output signal corresponding to the right speaker.

2. The method according to claim 1, wherein the step of converting the dual-channel audio signals to the multi-channel audio signals further comprises:

converting the dual-channel audio signals to original multi-channel audio signals; and performing dynamic gain adjustment on each of the original multi-channel audio signals according to characteristics of the dual-channel audio signals to generate the multi-channel audio signals.

3. The method according to claim 1, wherein the step of defining the four acoustic source positions of the left speaker and the right speaker comprises:

for each of the left speaker and the right speaker, setting a line connecting a first acoustic source position and a third acoustic source position among the four acoustic source positions and a line connecting a second acoustic source position and a fourth acoustic source position among the four acoustic source positions to be perpendicular to each other.

4. The method according to claim 1, wherein the step of converting the multi-channel audio signals to the four-channel audio signals of the left speaker and the four-channel audio signals of the right speaker comprises:

assigning four of the multi-channel audio signals to each of the four acoustic source positions of the left speaker; and assigning four of the multi-channel audio signals to each of the four acoustic source positions of the right speaker, wherein the multi-channel audio signals assigned to the left speaker are not exactly identical to the multi-channel audio signals assigned to the right speaker.

5. The method according to claim 4, wherein the multi-channel audio signals are five-channel audio signals comprising a left-channel audio signal, a right-channel audio signal, a center-channel audio signal, a left surround signal and a right surround signal, wherein the left-channel audio signal, the right-channel audio signal, the center-channel audio signal and the left surround signal are respectively assigned to the four acoustic source positions of the left speaker, and the left-channel audio signal, the right-channel audio signal, the center-channel audio signal and the right surround signal are respectively assigned to the four acoustic source positions of the right speaker.

6. The method according to claim 1, wherein the step of correcting the energy distributions of the four-channel audio signals of the left speaker and the right speaker according to the rotation angle and the four acoustic source positions comprises:

for the left speaker, setting a left gain curve of the four-channel audio signals of the left speaker according to the rotation angle and the four acoustic source positions; and for the right speaker, setting a right gain curve of the four-channel audio signals of the right speaker according to the rotation angle and the four acoustic source positions, wherein the left gain curve is different from the right gain curve.

7. The method according to claim 6, wherein the left gain curve and the right gain curve respectively follow a cardioid distribution and face in different directions.

8. The method according to claim 6, wherein the multi-channel audio signals are five-channel audio signals comprising a left-channel audio signal, a right-channel audio signal, a center-channel audio signal, a left surround signal and a right surround signal, wherein a gain value corresponding to the left-channel audio signal and a gain value corresponding to the left surround signal in the left gain curve are both greater than a gain value corresponding to the center-channel audio signal and a gain value corresponding to the right-channel audio signal in the left gain curve, wherein a gain value corresponding to the right-channel audio signal and a gain value corresponding to the right surround signal in the right gain curve are both greater than a gain value corresponding to the left-channel audio signal and a gain value corresponding to the center-channel audio signal.

9. The method according to claim 6, wherein the step of generating the left output signal corresponding to the left speaker and the right output signal corresponding to the right speaker comprises:

synthesizing the four-channel audio signals of the left speaker according to the left gain curve to generate the left output signal; and synthesizing the four-channel audio signals of the right speaker according to the right gain curve to generate the right output signal.

10. A system for correcting energy distributions of audio signal, comprising:

a head-mounted device, comprising a motion sensor, a left speaker and a right speaker;

a processing device, configured to:

detect a rotation angle of the head-mounted device by the motion sensor;

obtain dual-channel audio signals corresponding to the left speaker and the right speaker;

convert the dual-channel audio signals to multi-channel audio signals, wherein the number of channels of the multi-channel audio signal is greater than or equal to 5;

define four acoustic source positions of the left speaker and the right speaker to convert the multi-channel audio signals to four-channel audio signals of the left speaker and four-channel audio signals of the right speaker;

correct energy distributions of the four-channel audio signals of the left speaker and the right speaker according to the rotation angle and the four acoustic source positions to respectively generate a left output signal corresponding to the left speaker and a right output signal corresponding to the right speaker; and output the left output signal and the right output signal respectively by the left speaker and the right speaker.

11. The system according to claim 10, wherein the processing device is configured to:

assign four of the multi-channel audio signals to each of the four acoustic source positions of the left speaker; and assign four of the multi-channel audio signals to each of the four acoustic source positions of the right speaker, wherein the multi-channel audio signals assigned to the left speaker are not exactly identical to the multi-channel audio signals assigned to the right speaker.

12. The system according to claim 11, wherein the multi-channel audio signals are five-channel audio signals comprising a left-channel audio signal, a right-channel audio signal, a center-channel audio signal, a left surround signal and a right surround signal, wherein the left-channel audio signal, the right-channel audio signal, the center-channel audio signal and the left surround signal are respectively assigned to the four acoustic source positions of the left speaker, and the left-channel audio signal, the right-channel audio signal, the center-channel audio signal and the right surround signal are respectively assigned to the four acoustic source positions of the right speaker.

13. The system according to claim 10, wherein the processing device is configured to:

set a left gain curve of the four-channel audio signals of the left speaker according to the rotation angle and the four acoustic source positions; and set a right gain curve of the four-channel audio signals of the right speaker according to the rotation angle and the four acoustic source positions, wherein the left gain curve is different from the right gain curve.

14. The system according to claim 13, wherein the left gain curve and the right gain curve respectively follow a cardioid distribution and face in different directions.

15. The system according to claim 13, wherein the multi-channel audio signals are five-channel audio signals comprising a left-channel audio signal, a right-channel audio signal, a center-channel audio signal, a left surround signal and a right surround signal, wherein a gain value corresponding to the left-channel audio signal and a gain value corresponding to the left surround signal in the left gain curve are both greater than a gain value corresponding to the center-channel audio signal and a gain value corresponding to the right-channel audio signal in the left gain curve, wherein a gain value corresponding to the right-channel audio signal and a gain value corresponding to the right surround signal in the right gain curve are both greater than a gain value corresponding to the left-channel audio signal and a gain value corresponding to the center-channel audio signal.

16. A processing device for correcting energy distributions of audio signal, wherein the processing device is connected to or coupled to a head-mounted device having a motion sensor, a left speaker, and a right speaker, and wherein the processing device comprises:

a memory;

a processor, configured to:

obtain a rotation angle of the head-mounted device detected by the motion sensor from the head-mounted device;

obtain dual-channel audio signals corresponding to the left speaker and the right speaker from the head-mounted device;

convert the dual-channel audio signals to multi-channel audio signals, wherein the number of channels of the multi-channel audio signal is greater than or equal to 5;

define four acoustic source positions of the left speaker and the right speaker to convert the multi-channel audio signals to four-channel audio signals of the left speaker and four-channel audio signals of the right speaker;

correct energy distributions of the four-channel audio signals of the left speaker and the right speaker according to the rotation angle and the four acoustic source positions to respectively generate a left output signal corresponding to the left speaker and a right output signal corresponding to the right speaker.

17. The processing device according to claim 16, wherein the processor is configured to:

assign four of the multi-channel audio signals to each of the four acoustic source positions of the left speaker; and assign four of the multi-channel audio signals to each of the four acoustic source positions of the right speaker, wherein the multi-channel audio signals assigned to the left speaker are not exactly identical to the multi-channel audio signals assigned to the right speaker.

18. The system according to claim 16, wherein the processor is configured to:

set a left gain curve of the four-channel audio signals of the left speaker according to the rotation angle and the four acoustic source positions; and set a right gain curve of the four-channel audio signals of the right speaker according to the rotation angle and the four acoustic source positions, wherein the left gain curve is different from the right gain curve.

19. The system according to claim 18, wherein the left gain curve and the right gain curve respectively follow a cardioid distribution and face in different directions.

* * * * *